United States Patent [19]

Demuth et al.

[11] Patent Number: 5,038,440

[45] Date of Patent: Aug. 13, 1991

[54] CYLINDER ROLLER FOR A TEXTILE MACHINE WITH THE CYLINDER ROLLER HAVING WORKING POINTS

[75] Inventors: Robert Demuth, Nuerensdorf; Peter Fritzsche, Winterthur; Paul Stäheli, Wilen b. Wil; Roland Soltermann, Zürich, all of Switzerland

[73] Assignee: Maschinenfabrik Rieter AG, Winterthur, Switzerland

[21] Appl. No.: 513,510

[22] Filed: Apr. 26, 1990

[51] Int. Cl.[5] ..... D01G 15/84

[52] U.S. Cl. ..... 19/114

[58] Field of Search ..... 19/112, 114; 29/120, 29/121.2, 121.4–121.7, 123–127; 140/97

[56] References Cited

U.S. PATENT DOCUMENTS

| | | | |
|---|---|---|---|
| 11,861 | 10/1854 | Heneage | 19/112 |
| 405,234 | 6/1889 | Wickers | 19/112 |
| 411,105 | 9/1889 | Krausse | 19/112 |
| 433,620 | 8/1890 | Goddard | 19/112 |
| 986,415 | 3/1911 | White | 19/112 |
| 1,111,035 | 9/1914 | Rothe | 19/112 |
| 1,811,549 | 6/1931 | Langer | 19/114 |
| 4,394,789 | 7/1983 | Egerer | 19/114 X |
| 4,513,480 | 4/1985 | Bisquolm et al. | 19/114 X |
| 4,516,292 | 5/1985 | Quay | 19/114 X |
| 4,527,131 | 12/1986 | Iwata | 19/114 X |
| 4,606,095 | 8/1986 | Egerer | 19/114 X |
| 4,625,366 | 12/1986 | Egerer | 19/112 X |
| 4,716,629 | 1/1988 | Iwata et al. | 19/114 |
| 4,720,207 | 1/1988 | Salani | 29/123 X |
| 4,737,223 | 4/1988 | Koch | 29/121.6 X |

FOREIGN PATENT DOCUMENTS

| | | | |
|---|---|---|---|
| 2503976 | 8/1975 | Fed. Rep. of Germany . | |
| 3336825 | 7/1984 | Fed. Rep. of Germany . | |
| 3624292 | 1/1988 | Fed. Rep. of Germany . | |
| 1484526 | 5/1967 | France | 19/114 |
| 2212826 | 8/1989 | United Kingdom | 19/114 |

*Primary Examiner*—Werner H. Schroeder
*Assistant Examiner*—John J. Calvert
*Attorney, Agent, or Firm*—Sandler, Greenblum, & Bernstein

[57] ABSTRACT

A cylinder for a textile machine to be used as a licker-in, main cylinder or doffer has working clothing attached to the base structure. The clothing is attached in segments that have a regular geometric shape and a width less than the cylinder width. The segments are secured to the base structure so that the junctions, in the peripheral direction, are displaced from one another. Each segment is provided with a form locking edge to innerlock the segments in the cylindrical form.

26 Claims, 6 Drawing Sheets

CYLINDER ROLLER FOR A TEXTILE MACHINE WITH THE CYLINDER ROLLER HAVING WORKING POINTS

BACKGROUND OF THE INVENTION

The invention relates to a cylinder roller for a textile machine with the cylinder roller having working points, for example the licker-in roll, main cylinder or doffer of a card or the cleaning roller of a blow room machine.

Such cylinder rollers are equipped, depending on the particular task, with a spiked clothing or with a saw tooth clothing and, depending on the particular use, the spikes can be formed by wires of different thickness and the teeth can be executed with different tooth spacings and different sizes. In the case of a spike clothing the wires forming the working points are mainly anchored into a fabric strip. In the case of a saw tooth clothing the teeth are stamped out of an appropriate sheet metal strip and are subsequently ground in order to precisely set the tooth form and to reduce the tooth width in comparison to the base part, whereby in practical use lateral spacings arise between adjacent rows of saw teeth. Both products, i.e. spike clothings and saw tooth strips are available by the meter and are wound during the manufacture of cylinder rollers having working points around the circumference of a drum-like base structure.

In practical use these expensive clothings must be exchanged after longer periods of time due to the effects of wear. It can also transpire that such clothings have to be prematurely exchanged because of locally restricted damage to the working points. In both cases a fairly extensive dismantling of the textile machine is necessary in order to insert the newly clothed cylinder roller. It is also known to draw the saw tooth clothings onto the textile machine itself, whereby the expense of dismantling is substantially smaller. Nevertheless a draw-on process of this kind still requires a relatively large amount of work.

After the draw on process it can be necessary to grind the cylinder roll having the working points so that all working points have precisely the same radial spacing from the rotational axis of the cylinder roll.

SUMMARY OF THE INVENTION

It is the object of the present invention to provide a novel cylinder roll having working points of the initially named kind which is cost favorable to manufacture and which enables the repair of damaged regions, or the interchanging of all the working points, without having to build the cylinder roller completely out of the machine. Furthermore, subsequent grinding procedures should be avoided as far as possible.

In order to satisfy this object, provision is made, in accordance with the invention, that the cylinder roller comprises a base structure and clothing segments which are attached thereto and which have the working points, wherein the clothing segments have a regular geometrical shape and are securable adjacent to one another on the base structure to the latter in a repeating arrangement which results in the cylindrical shape.

In this way it is possible, in the event of damage to the working points of the cylinder roller to exchange only one, or, if necessary several clothing segments without having to interchange the entire cylinder roller or the entire working points. When the total cylinder roller is worn, it is possible to exchange the clothing segments while the roller is built into the textile machine, whereby the cost of work and the costs of renewing the working points are likewise reduced. Through the mounting of the working points on the clothing segments, it is also straightforwardly possible to pre-grind these segments in a jig so that the working points have the nominal radial spacing from the axis of rotation of the cylinder roller, or have the radial spacing of the other already installed working points.

In the simplest case, the clothing segments comprise at least two semi-cylindrical shells. Even with this simple embodiment the segments can be interchanged individually or together, since the circumferential extent of the segments, which amounts to less than the half of the cylinder roller, permits the extraction of the latter in a radial direction, which is mainly possible by removing the normal cladding of the machine and turning the roller into a favourable angular position. In this way, it is in most cases not necessary to dismantle the support for the cylinder roller at its end faces.

An even number of semicylindrical shells is preferably provided, which can be mounted pairwise in two or more rows alongside one another on the base structure. An arrangement of this kind is particularly preferred in which, as seen in the circumferential direction of the roller, each row is arranged displaced relative to the neighboring rows. In this manner, the grooves between the working points, which are generally difficult to avoid at the abutting edges between neighboring segments, are so distributed over the circumference of the cylinder roller that they are not disturbing in operation, or only disturb to an insignificant degree. With only two semi-cylindrical shells or several shells aligned in the circumferential direction, empty spaces would extend over, the entire width of the cylinder roller between neighboring shells and these empty spaces are really undesired.

The semi-cylindrical embodiment of the segments does not necessarily represent an optimum. With large cylinder rollers in particular, for example with a tambour (main cylinder of a card), one prefers arrangements in accordance with the invention in which the clothing segments comprise three or more partly cylindrical segments. In this way, the circumferential extent of the individual segments is smaller which makes them easier to handle during installation and dismantling. With this embodiment, with partly cylindrical segments which extend over less than half the circumference of the cylinder roller, one also prefers an arrangement where the clothing segments are arranged in several rows which are each displaced relative to neighboring rows in the circumferential direction of the roller.

A further embodiment which has the special advantage that the abutment regions between the neighboring segments have a shorter linear extent, is characterized in that the segments have a cylindrically curved shape which is polygonal in plan view, for example a triangular, hexagonal or diamond-like shape with part segments optionally being providable at the end edges of the cylinder roller.

In order to secure the segments to the base structure, a particular preferred embodiment of the invention provides that the base structure is a drum having an opening at at least one end face; and that the segments are securable to the drum by means of fastening elements which are accessible from the interior of the drum. In the simplest case, these fastening elements can comprise screws which engage into corresponding threads in the segments. It would also be possible to secure the segments to the drum from the outside, with the securing screws then engaging into threaded bores of the jacket surface of the drum. An arrangement of this kind has, however, the disadvantage that the working tips cannot be straightforwardly provided in the region of the screw heads so that empty spaces arise here which are not absolutely desirable.

In accordance with the invention various other embodiments are, however, also provided for the securing of the segments to the base structure. A particular preferred embodiment is characterized in that the segments are releasably held on the base structure by means of grooves which extend in the circumferential direction and/or in the transverse direction in the base structure or in the segments, with the grooves being in form-locked connection with correspondingly shaped ribs formed on the other respective part.

By way of example, the segments can have dovetail-like grooves or projections at their radially inwardly facing side opposite to the base structure, with these grooves or projections cooperating with projections or grooves of complementary shape in the base structure. It is simplest with an arrangement of this kind when the dovetail-like grooves are provided in the transverse direction of the base structure, since the clothing segments can then be easily inserted from the one end face of the base structure. It is, however, also possible to provide grooves and projections which extend in the circumferential direction of the base structure, although here the grooves and projections must be locally interrupted to enable the introduction of the segments. According to the invention, it is also possible for the segments to have bores which extend in the transverse direction of the roller and for them to be securable to the base structure by means of bars which extend through these bores.

In the case of a spike clothing which is formed by a clothing with a support fabric having wire tips, the support fabric is preferably bonded to the clothing segments, with the fabric preferably having the shape of the segments as seen in plan view. Through this construction regions lacking in points at the abutment edges between the individual clothing segments can be largely avoided. The spike clothing is thus similarly constructed to the spike clothing of a revolving flat.

As an alternative to this, the working points can be formed by a saw tooth clothing which is secured in form-locked manner to the clothing segments, with the saw tooth clothing taking the form of strips curved in the circumferential direction of the cylinder roller. The form-locked mounting can, for example, take place by lip-like projections of the segments which engage over the ends of the strips, and these lip-like projections can be plastically deformed around the ends of the strips or into grooves of these strips provided for this purpose so as to clamp the strips to the segments.

The possibility also exists, amongst other things, of providing the saw tooth strips with dovetail-like grooves of projections at their side facing the segments, with the grooves or projections cooperating with corresponding projections or grooves at the outer surface of the segments and bringing about a form-locked mounting of the strips on the segments. It is, however, also conceivable to provide holes at regular intervals in the saw tooth strips and to then secure these strips to the segments by means of wires which extend in the axial direction of the cylinder roller. Such bores or dovetail-like grooves of projections can be stamped out at the same time as the working points are stamped out, so that the manufacturing complexity is hardly any greater.

Although an exchange of the segments is possible in many cases by radial removal from the base structure, the segments are preferably so provided that they are removable from one end face of the base structure. Depending on the layout of the segments, this is in many cases possible without one having to dismantle the mounting for the cylinder roller, so that the basic alignment of the cylinder roller with the textile machine is not impaired. In this way it is generally also possible to avoid having to dismantle the drive means for the cylinder roller.

Finally, it must also be mentioned that it would basically be possible to provide the segments in ring form. For example, the individual rings could be pushed from one end face onto a drum-like base structure and secured to the latter by axial clamping. A construction of this kind admittedly requires further dismantling of the textile machine at one end face of the cylinder roller than the other embodiments. However, one would in this way largely be able to avoid empty spaces at the abutting edges between the individual segments.

BRIEF DESCRIPTION OF THE DRAWINGS

Examples of the invention will now be explained in the following in more detail with reference to the drawings, which show.

DETAILED DESCRIPTION OF THE PREFERRED EMBODIMENTS

Figure 1:
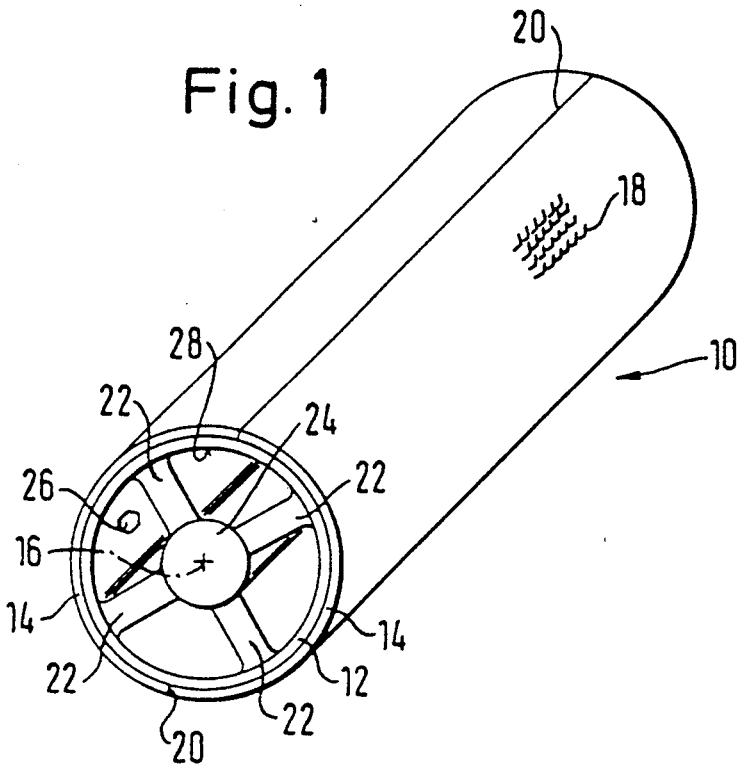
FIG. 1 a perspective representation of a first embodiment of the concept of the invention with only two half shells, FIG. 2 a further embodiment of the concept of the invention with several half shells, FIG. 3 an embodiment similar to that of FIG. 2, however with part shells which adopt less than half the circumference of the cylinder rollers, FIG. 4 a perspective illustration of an embodiment of the concept of the invention having several elongate strips, FIG. 5 a perspective illustration of three variants of the concept of the invention with diamond-like, triangular and hexagonal clothing segments, FIG. 6 an end view of a clothing segment with wire points, FIG. 7 an end view of a clothing segment in accordance with the invention having saw-tooth strips which are secured to the segment by means of lip-like projections, with the mounting to the base structure also being shown, FIG. 8 a further schematic illustration of a clothing segment in accordance with the invention in which individual saw-tooth strips are secured in form-locked manner to the clothing segments by means of dovetail-like grooves and projections, with the mounting to the drum-like base structure also being shown here, FIG. 9 a further embodiment of a clothing segment in accordance with the invention in which saw tooth strips which themselves form the segments are directly securable to the drum, FIG. 10 a perspective illustration of an end view of a base structure to which clothing segments are securable by means of dovetail-like guides, FIG. 11 a perspective illustration of an alternative base structure in which clothing segments are securable by means of dovetail-like guides extending in the circumferential direction of the base structure, FIG. 12 a schematic illustration of an alternative possibility of securing the clothing segments to the base structure, with the illustrated parts of the clothing segment and of the base structure being shown as a straight line rather than a curve, simply for the sake of illustration, FIG. 13 a schematic illustration corresponding to FIG. 12, however of a further alternative, FIG. 14 a schematic illustration corresponding to FIG. 13, however of a yet further alternative, and FIG. 15 a greatly simplified perspective illustration of a cylinder roller with rows of working points inclined in the circumferential direction.

FIG. 1 first shows a cylinder roller 10, for example a doffer of a card which consists of a drum-like base structure 12 and two half shells 14. Each half shell 14 extends over an angle of 180° about the axis of rotation 16 of the roller. The half shells carry a needle clothing of wires 18 at their surface, with the total surface of the two half shells being covered with these wires, although in FIG. 1 only a part region is shown provided with needles in order not to make the drawing unnecessarily complicated.

The abutment edges between the two half shells are characterized by 20. With this wire-spike embodiment it is also possible to bring the needles very close to the abutment edges 20 so that no particular disruption of the needle covered surface occurs in the region of the abutment edges 20.

FIG. 1 also shows how the drum-like base structure 12 is secured by means of radially extending arms 22 to the hub part 24, which is necessary for the mounting of the cylinder roller in the textile machine. This mounting is not shown here because it does not belong to the present invention. Similar radial arms 22 and hub parts 24 are also provided in the further embodiments.

As will later be explained in more detail in connection with FIG. 6 the wire needles 18 are firmly anchored into a fabric which is bonded to fixed metallic segments. The mounting of the segments to the drum 12 takes place by means of screws which are inserted from the inside of the drum and engage into threads provided in the segments, as will be explained later with reference to FIG. 6. Simply for the sake of illustration, the head of a screw 26 is shown in FIG. 1 and one can see that this head is accessible through the opening 28 between the arms 22.

The working tips of the half shells 14 of the embodiment of FIG. 1 do not have to consist of wire needles, they can for example equally consist of saw-tooth segments as will be explained later in connection with FIG. 7.

Figure 2:
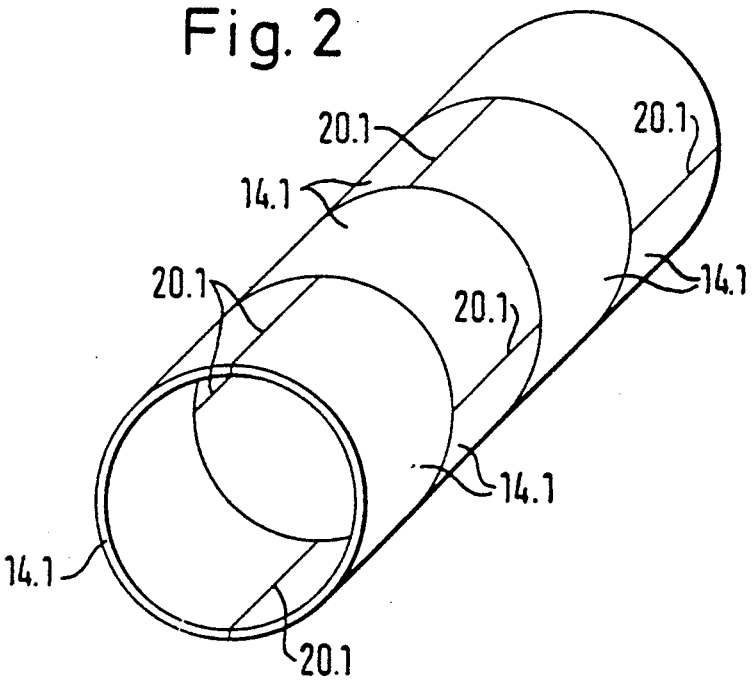

In this case it is simpler, for technical manufacturing reasons, to provide the half shells with a somewhat smaller axial length. FIG. 2 shows an embodiment of this kind in which four pairs of half shells 14.1 are arranged alongside one another. For the sake of illustration, the base structure, i.e. the drum 12 in FIG. 2, is omitted. The abutting edges 20.1 between the pairs of half shells are displaced in each row relative to the adjacent rows so that no regions which are devoid of saw teeth and which extend over the whole axial length of the roller are present at the abutment edges 20.1.

The displacement of the individual half shells in the individual rows can be so effected that the abutting edges in one row are displaced relative to the abutting edges in all other rows. This is however not shown in FIG. 2.

Figure 3:
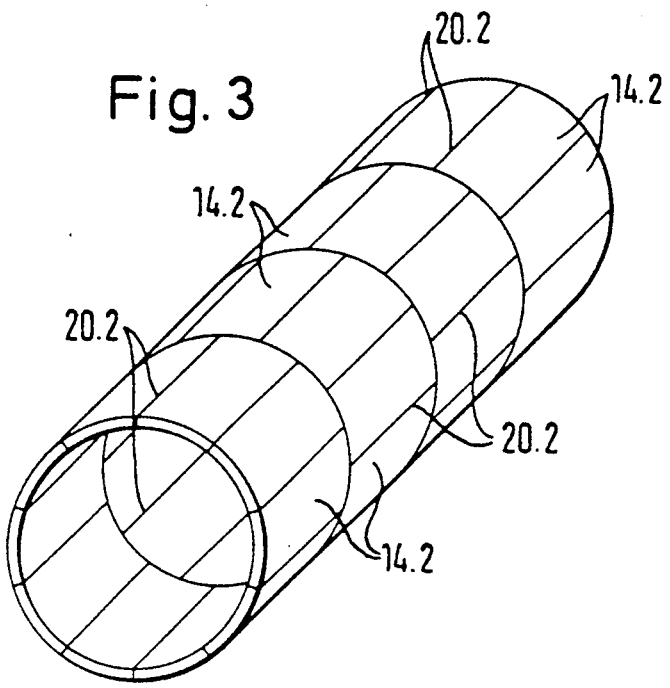

The present invention is in no way restricted to two half shells. FIG. 3 shows an arrangement with a total of 40 shell segments which are arranged in four rows of ten segments each, with each segment 14.2 having an angular extent of 36°. Here the abutting edges 20.2 are also displaced relative to the abutting edges of neighboring rows. In addition, the base structure has also been omitted here for the sake of illustration.

Figure 4:
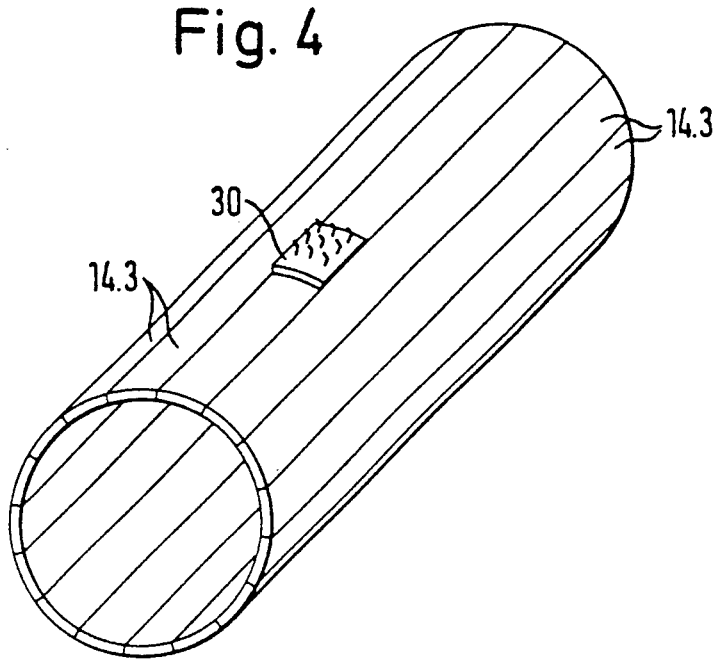

FIG. 4 again shows a segment arrangement with 16 strip segments 14.3 which each extend over the full length of the cylinder roller. An arrangement of this kind is suitable for a needle clothing with wire needles which are embedded and held in a fabric, with this fabric being bonded in strip form to the segments 14.3, with the strips having the shape of the segments 14.3, which is only indicated regionally at 30 in FIG. 4. The strips having the needle clothing can be formed in the manner which is customary for the needle clothings of revolving flats.

Figure 5:
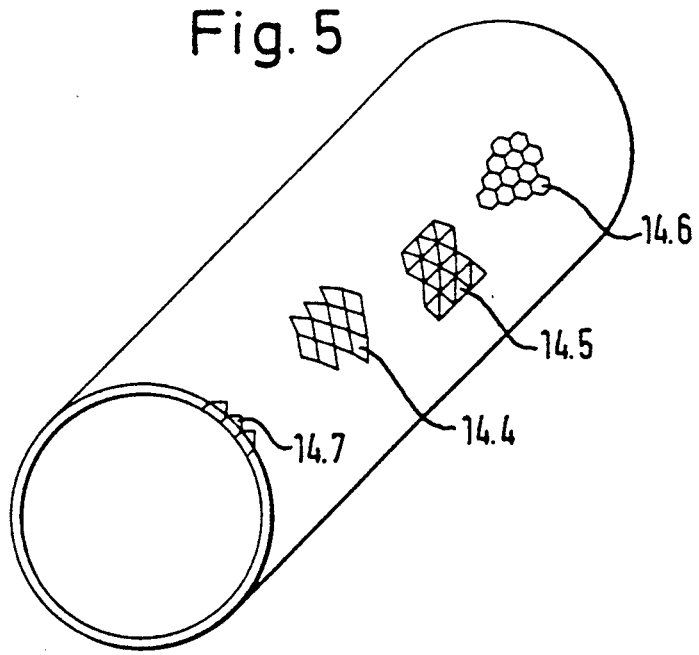

FIG. 5 shows three further alternative types of segment which are here formed as mosaic tiles. In the first case the segments 14.4 are diamond-like segments. In place of this the segments could also have a triangular shape 14.5 or a hexagonal shape 14.6, and finally any form of polygonal shape is possible providing the segments can fully cover a surface. In some embodiments of the mosaic tiles, half segments must be provided in order to also achieve a continuous cover of the base structure at the end edges of the cylinder roller, as is for example indicated at 14.7.

Figure 6:
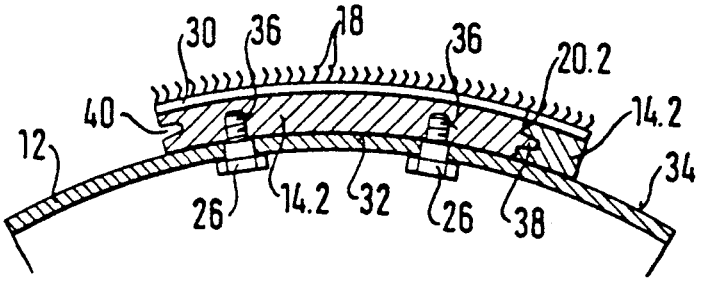

FIG. 6 now shows an end view as to how a segment, for example a segment such as 14.2 of FIG. 3, can be secured to the drum-like surface of the base structure 12. As evident, the segment 14.2 has a curved inner surface 32 which has precisely the same curvature as the outer surface 34 of the drum. Four threaded bores 36 are provided in the segment 14.2 of which only two are visible in FIG. 6. The segments can be drawn tight onto the base structure by means of screws 26, the drive heads of which are located in the internal space of the drum-like base structure 12. The segments can also have a nose 38 and a recess 40 at their respective edges in the circumferential direction so that each segment 14.2 is held in form-locked manner at the circumferential edge by the neighboring segment 14.2. With suitable shaping, the noses and the recesses can be so laid out that it is nevertheless possible to release individual segments from the drum, for example by first releasing two neighboring segments and then tightening them again pairwise onto the drum surface by means of the screws 26.

FIG. 6 shows in detail how the wire tips 18 project out of a fabric 30, with the fabric 30 frequently being bonded to the curved outer surface of the segment 14.2. In this manner, no circumferential grooves arise at the abutment edges 20.2 because the wire spikes can be led at least substantially up to the edge of the strips.

Figure 7:
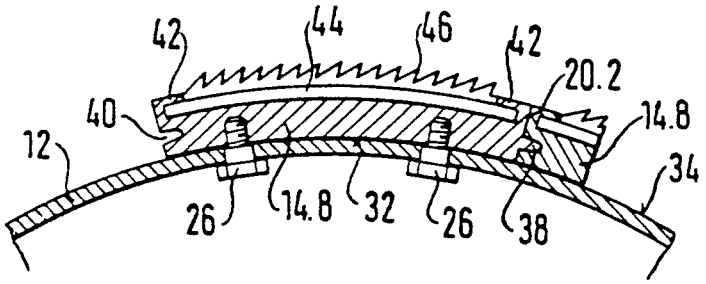

FIG. 7 shows an embodiment similar to that of FIG. 6 in which the segments 14.8 are likewise drawn onto the drum surface by means of screws 26. For the sake of brevity the parts in FIG. 7 which correspond to parts of FIG. 6 are designated by the same reference numerals and will not be specially described. The embodiment of FIG. 7 is equipped with saw-tooth strips, with these saw-tooth strips having a curvature corresponding to the curvature of the outer surface of the segment 14.8 and being secured at their end edges by means of inwardly deformed edge parts 42 of the segments 14.8. Although not shown in FIG. 7, several saw-tooth strips are placed alongside one another on the segment, with each strip having in known manner a broader shoulder region 44 and a narrower width at the working points, so that the working points 46 are spaced from each other. At the abutment edge between two segments, for example at 20.2 a small spacing arises here having the width of one tooth.

Figure 8:
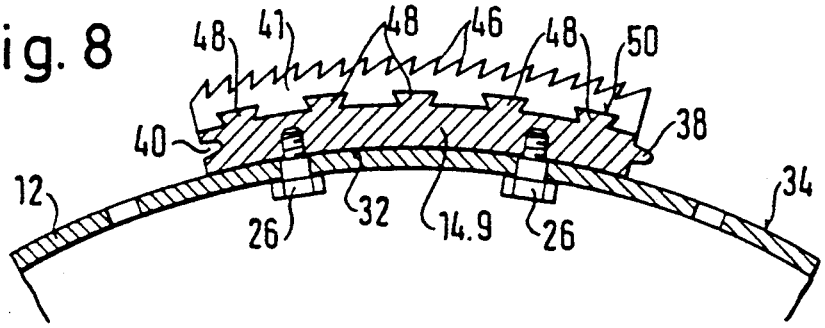

FIG. 8 shows a further embodiment of securing the saw-tooth strips 41 to the segments 14.9. In this embodiment parts which are already known are designated with the same reference numerals as before and will not be specially described. In the embodiment of FIG. 8, one sees that the segment 14.9 has dovetail-like guides 48 at its outer side, with these guides engaging into complementary dovetail-like openings 50 in the saw-tooth strips 41 and thus securing the saw-tooth strips in form-locked manner to the segment. This embodiment has the special advantage that individual saw-tooth strips on individual segments are interchangeable.

Figure 9:
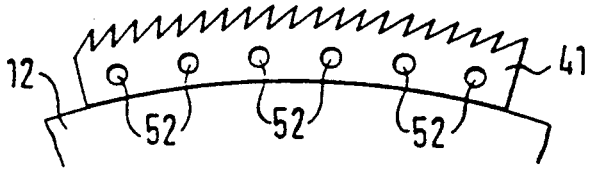

In the embodiment of FIG. 9, the saw-tooth strips themselves form the segments. For this purpose they are made somewhat deeper than previously in the radial dimension and provided with throughgoing holes 52. The matching drum structure is constructed as a bird cage, with the individual cage bars extending through the holes 52. The exchanging of the saw-tooth strips is possible here by pulling the bars out regionally and removing the corresponding saw-tooth strips. As an alternative to the this, the base structure can have the form of a drum with a plurality of radially outwardly projecting flanges, with grooves into which the saw-tooth strips are inserted being provided between the ring-like flanges. These flanges also have bores corresponding to the bores 52 so that the bars can pass both through the saw-tooth strips and also through the flanges. A mounting of this kind is particularly suitable for a cylinder roller of a cleaning machine where a relatively coarse tooth form is used.

Figure 10:
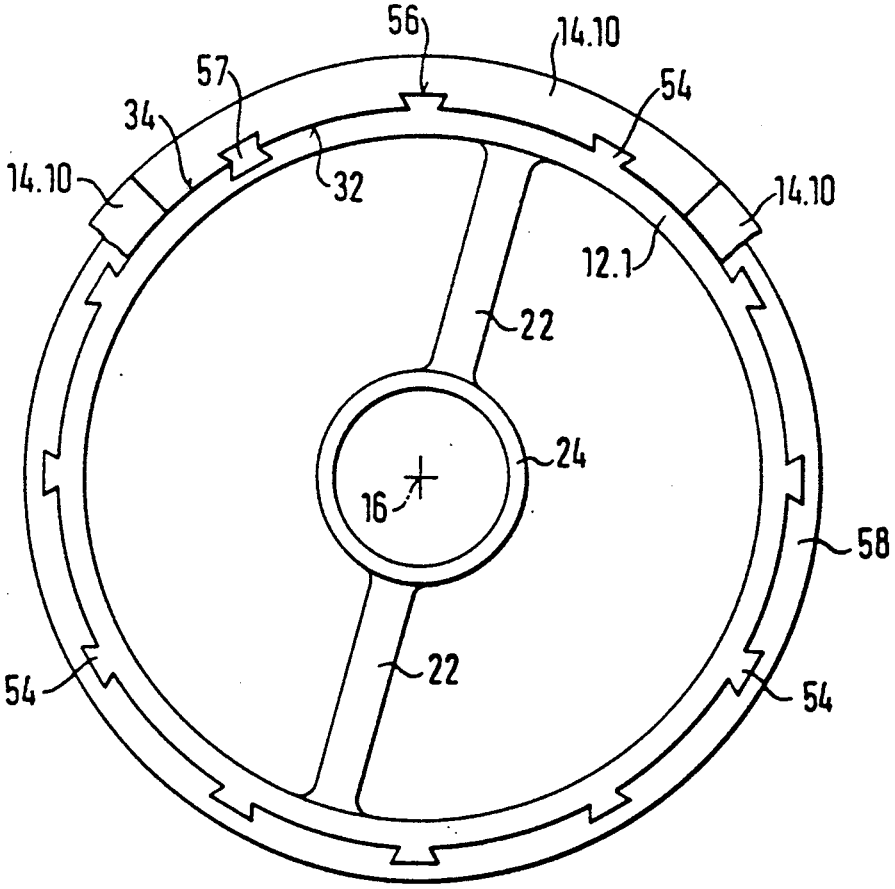

FIG. 10 shows an embodiment for mounting individual segments 14.10 to the drum-like base structure 12.1 by means of dovetail-like guides 54 which extend in the transverse direction of the roller and which engage into dovetail-like grooves 56 of complementary shape in the inner sides of the segments 14.10. For the sake of illustration, the working points are omitted here. They can, however, be executed as wire points or as saw-tooth points and can, for example, be secured to the segments 14.10 in accordance with the previously described embodiments.

FIG. 10 also shows a flange 58 at the rear end edge of the cylinder roller as seen in the drawing, with this flange serving as an abutment for the segments 14.10 which are inserted in the axial direction. In order to show this flange 58 the other segments in FIG. 10 are broken away.

FIG. 10 also shows a further alternative, namely the mounting of the segments 14.10 to the base structure 10 by means of throughgoing strips 57. The strips 57 can have the cross-sectional shape of two oppositely directed dovetail guides which are secured to one another. In this case, corresponding dovetail guides are provided both in the segments and also in the base structure. The strips can be inserted sideways in the form of prefinished strips. They can, however, also be produced by casting the corresponding spaces out with lead, a low melting point alloy, a resin composition or plastic. In this case, the mounting between the clothing segments and the base structure is finished after hardening or curing of the material.

Figure 11:
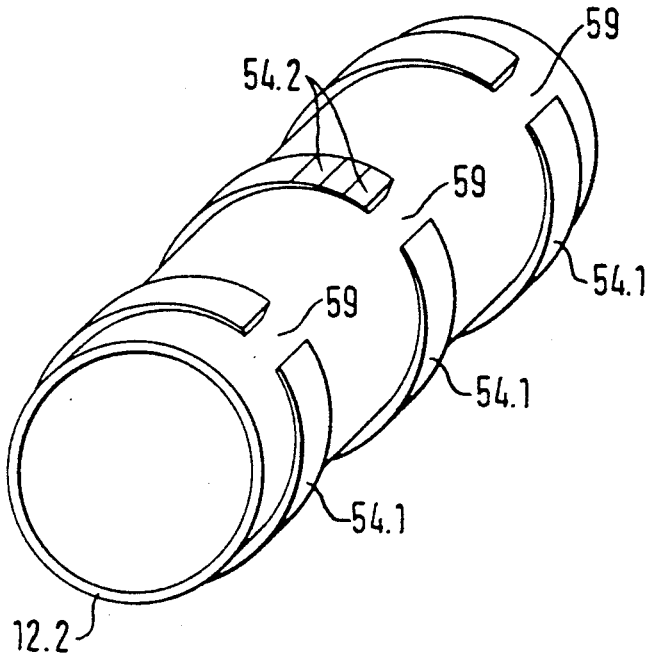

The dovetail-like guides do not necessarily have to extend in the transverse direction of the roller but rather they can extend in the circumferential direction as shown in FIG. 11. The embodiment of FIG. 11 would, for example, be suitable for a segment shape in accordance with FIG. 4, i.e. segments which have a length corresponding to the length of the cylinder roller which are, however, relatively narrow in width. To enable the introduction of the segments the drum has at least one row of positions 59 where the circumferentially extending dovetail guides 54.1 are interrupted. The individual strips can be inserted at these positions and then displaced in the circumferential direction. The regions 59 are thus to be regarded as filling slots. After inserting the last strip, all the strips are displaced backwards by one half strip so that the two last inserted strips are also carried by the dovetail-like guides 54.1. A secure mounting of the last inserted strips can then be achieved with other mechanical means, for example with a screw which engages into a threaded bore formed at the joint between the two strips, i.e. with one half of the threaded bore in the one strip and the other half of the threaded bore in the other strip.

A further embodiment lies in dividing the circumferentially extending dovetail-like guides 54.1 into various narrow strips, for example as shown in 54.2. The segments to be inserted then have a corresponding subdivision of the dovetail-like groove recesses, so that they can be inserted radially. After radial insertion, the strips are displaced through half their width so that they are held in form-locked manner.

The above described embodiments only represent some of all the contemplated embodiments which exist for realizing the invention in practice.

Further embodiments are shown in FIGS. 12 to 15.

Figure 12:
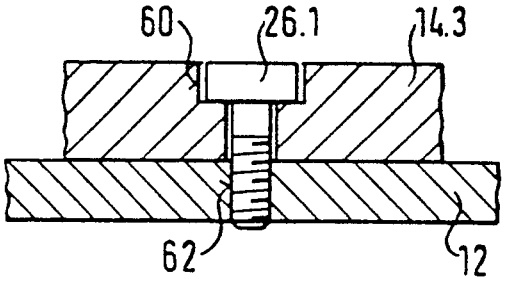

In FIG. 12 the clothing segments, which can, for example, be formed in correspondence with the segments 14.2 of FIG. 3, are secured by means of throughgoing screws 26.1 to the base structure 12. In so doing, the screws 26.1 thereby pass through radial bores 60 and 60.2 which are aligned with one another and which are formed in the clothing segments 14.3 and in the base structure 12, respectively. The bores 60 are formed as stepped bores so that the head of the screw 26.1 can be arranged sunk beneath the radially outer surface of the clothing segment 14.3. The threaded part of the screw 26.1 engages into the bore 62 of the base structure 12 with this bore being formed as a threaded bore.

Figure 13:
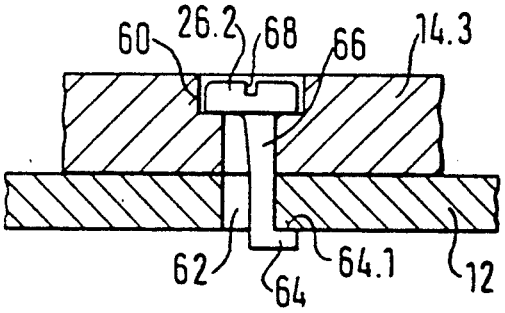

FIG. 13 shows a similar construction, however with a somewhat different securing means 26.2. Here the securing means 26.2 has a claw 64 at its lower end which is connected by means of a limb 66 with the head of the screw 26.2. The claw is so constructed that it can be inserted through the mutually aligned bores 60 and 62 and then passes behind the radially inner surface of the base structure 12 and is anchored here by rotation of the head of the screw, for example by means of the screw driver slot 68. In order to facilitate this, the claw 64 has a surface 64.1 which is formed as a ramp which also makes it possible to tighten the screws 26.2.

Figure 14:
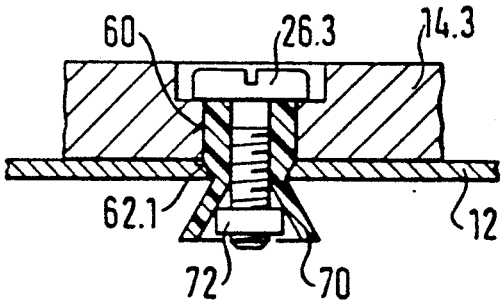

In the securing means of FIG. 14 a spreading dowel 70 is used in order to realize the fastening.

After mounting the segment 14.3 on the base structure 12, the dowel 70 is pushed through the mutually aligned bores 68 and 62.1 with the conical shape of the bore 62.1 preventing the dowel 70 which is inserted from migrating too far inwardly. Finally, the screw 26.3 is inserted through the dowel and tightened, whereby the nut 72, which cooperates with the screw 26.3, takes care of the spreading of dowel 70 and, thus, the anchoring of the clothing segment 14.3 on the base structure 12. The use of a nut 72 of this kind is not absolutely essential. The screw 26.3 could, for example, bring about adequate spreading of the dowel to ensure the anchoring without the nut.

In the examples of FIG. 12 to 14, the heads of the screws can, if desired, be covered over with covers, including covers which themselves carry needle clothings. These covers could, for example, be bonded onto the screw heads or could be provided with screws which can be threaded into corresponding threaded bores of the screws 26.1, 26.2 or 26.3 respectively, i.e. approximately in the manner of cover caps with bathroom mirrors.

Figure 15:
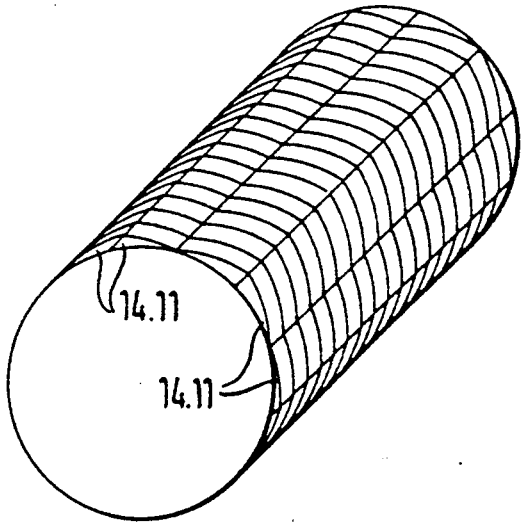

Finally, FIG. 15 shows that the roWs of working points of clothing segments which follow one another in the circumferential direction of the cylinder roller can form an angle with the circumferential direction. This has the special advantage that the "alleys" between the rows of working points are not straight and aligned in the circumferential direction of the cylinder roller but rather form a zig-zag track, with individual fibres being repeatedly brought back into the working region of the working tips, so that on the whole a high degree of efficiency is achievable.

We claim:

1. A cylinder roller having working points for use in a textile machine, said cylinder roller comprising:

a base structure having a generally cylindrical shape;

a plurality of partly cylindrical clothing segments having the working points thereon, substantially covering said generally cylindrical base structure;

said clothing segments having at least one predeterminate geometrical shape and being attached to said base structure and to one another in a repeating arrangement;

said clothing segments being arranged in a plurality of rows extending in a peripheral direction around said cylindrical base structure, whereby peripherally adjacent clothing segments of a first peripherally extending row have a respective junction which is displaced in said peripheral direction from corresponding junctions of adjacent peripherally extending rows of clothing segments.

2. The cylinder roller of claim 1, wherein:

said cylinder roller has a predeterminate axial length; and wherein said junction is less than said predeterminate length.

3. The cylinder roller of claim 1, wherein:

said base structure extending axially length-wise; and said clothing segments comprise at least two length-wise adjacent rows of semi-cylindrical shells.

4. The cylinder roller of claim 1, wherein:

said base structure is a drum having an opening at at least one end and an interior; and said cylinder roller further comprises means for securing said clothing segments to said drum from within said interior of said drum.

5. The cylinder roller of claim 4, wherein:

said means for securing comprise screws which are threadably engageable with respect to said clothing segments.

6. The cylinder roller of claim 1, further comprising:

means for securing said clothing segments to said base structure, comprising:

grooves formed in said clothing segments; and ribs formed in said base structure, for engaging in a form-locked manner within respective ones of said grooves of said clothing segments.

7. The cylinder roller of claim 6, wherein:

said grooves and said ribs extend in said peripheral direction.

8. The cylinder roller of claim 6, wherein:

said grooves ad said ribs extend in an axial direction of said cylinder.

9. The cylinder roller of claim 1, further comprising:

means for securing said clothing segments to said base structure, comprising:

grooves formed in said base structure; and ribs formed in said clothing segments, for engaging in a form-locked manner within respective ones of said grooves of said base structure.

10. The cylinder roller of claim 9, wherein:

said grooves and said ribs extend in said peripheral direction.

11. The cylinder roller of claim 9, wherein:

said grooves and said ribs extend in an axial direction of said base structure.

12. The cylinder roller of claim 1, wherein:

said clothing segments comprise bores extending in an axial direction of said base structure; and said cylinder roller further comprises bars extending through said bores for securing said clothing segments to said base structure.

13. The cylinder roller of claim 1, wherein:

said working points are formed as strips, curved in said peripheral direction; and wherein said cylinder roller further comprises means for securing said strips, in a form-locked manner, to said clothing segments.

14. The cylinder roller of claim 13, wherein:

said means for securing said strips further comprises rib-like projections on said clothing segments engaging ends of said strips.

15. The cylinder roller of claim 14, wherein:

said rib-like projections are plastically deformed around said ends of said strips.

16. The cylinder roller of claim 1, wherein:

said cylinder roller further comprises means for securing said clothing segments to said base structure, said means for securing comprising headed mounting fasteners;

said clothing segments have stepped bores, extending radially towards an axis of said cylindrical base structure, for receiving said headed mounting fasteners exteriorly of said base structure, said base structure having radial bores corresponding to said bores of said clothing segments, whereby said headed mounting fasteners are adapted to be countersunk beneath a radially outer surface of said clothing segments.

17. The cylinder roller of claim 16, wherein:

said mounting fasteners are rotary fasteners, each rotary fastener having a claw and a limb connecting said claw with a rotatable head, said claw being insertable through a respective one of said bores of said clothing segments and one of said bores of said base structure and being engageable behind said base structure by means of a rotary movement.

18. The cylinder roller of claim 16, wherein:

said mounting fasteners are: (1) spreadable dowels insertable through respective radial bores of said clothing segments and said bores of said base structure and (2) respective screws insertable within said dowels.

19. The cylinder roller of claim 18, wherein:

said mounting fasteners further comprising nuts for respective ones of said screws for effecting said spreading of said dowels upon rotation of said screws.

20. The cylinder roller of claim 1, further comprising means for securing said clothing segments to said base structure, comprising:

grooves formed in said clothing segments and corresponding grooves formed in said base structure; and strips having a shape complementary to said grooves, each of said strips being insertable within a respective one of said grooves of said clothing segments and a respective one of said grooves of said base structure for securing said clothing segments to said base structure in a form-locked manner.

21. The cylinder roller of claim 20, wherein:

said strips have a cross-sectional form of two oppositely directed dovetail grooves secured to one another, and wherein said grooves are made of a material adapted to be cast in place after placement of said clothing segments upon said base structure.

22. The cylinder roller of claim 21, wherein:

said strips are made of a material selected from the group consisting of lead, synthetic resin, and plastic.

23. The cylinder roller of claim 1, wherein:

each of said clothing segments has a first edge including a nose extending in said peripheral direction, and a second edge including a recess extending in an opposite peripheral direction for receiving a respective nose of a peripherally adjacent clothing segment.

24. A cylinder roller having working points for use in a textile machine, said cylinder roller comprising:

a base structure having a generally cylindrical shape;

a plurality of partly cylindrical clothing segments having the working points thereon, substantially covering said generally cylindrical base structure;

said clothing segments having at least one predeterminate geometrical shape and being attached to said base structure and to one another in a repeating arrangement; and said clothing segments being arranged in a peripheral direction around said cylindrical base structure, each of said clothing segments having a first edge including a nose facing in said peripheral direction, and a second edge including a recess facing in an opposite peripheral direction for receiving a respective nose of a peripherally adjacent clothing segment.

25. The cylinder roller of claim 24, further comprising:

means for securing said clothing segments to said base structure.

26. The cylinder roller of claim 24, wherein:

each of said clothing segments has a respective predeterminate width;

each of said noses and each of said recesses extend axially of said cylindrical base structure along substantially said respective predeterminate width of said clothing segments; and said working points are provided on each of said clothing segments substantially from said first edge to said second edge.

* * * * *